United States Patent [19]

Fowler

[11] Patent Number: 4,490,002

[45] Date of Patent: Dec. 25, 1984

[54] RELEASABLE CABLE CONNECTOR ASSEMBLY FOR USE BETWEEN A MOBILE AND STATIONARY OBJECT

[75] Inventor: Orren V. Fowler, San Jose, Calif.

[73] Assignee: The United States of America as represented by the Secretary of the Air Force, Washington, D.C.

[21] Appl. No.: 445,887

[22] Filed: Dec. 1, 1982

[51] Int. Cl.[3] ..... H01R 13/62

[52] U.S. Cl. ..... 339/45 M

[58] Field of Search ..... 339/45, 65, 66, 117

[56] References Cited

U.S. PATENT DOCUMENTS

| | | | |
|---|---|---|---|
| 2,358,972 | 9/1944 | Hallett | 339/117 R |
| 2,775,745 | 12/1956 | Eaton | 339/45 M |
| 2,986,613 | 5/1961 | Figueira | 339/45 R |
| 3,129,044 | 4/1964 | Lyman et al. | 339/66 M |
| 3,374,457 | 3/1968 | Herrick | 339/45 M |
| 3,496,519 | 2/1970 | Vetter | 339/45 |
| 3,497,862 | 2/1970 | Jeffner | 339/45 M |
| 3,518,613 | 6/1970 | Alpert | 339/45 |
| 3,611,274 | 10/1971 | Low | 339/278 M |
| 3,963,297 | 6/1976 | Panek et al. | 339/117 R |
| 4,138,181 | 2/1979 | Hacker et al. | 339/45 R |
| 4,184,731 | 1/1980 | Betzmeir | 339/45 M |

*Primary Examiner*—John McQuade
*Assistant Examiner*—David L. Pirlot
*Attorney, Agent, or Firm*—Donald J. Singer; Jacob N. Erlich

[57] ABSTRACT

A cable connector assembly for releasably securing a pair of cable portions of a cable together, the cable connector assembly having a stationary housing made up of two outer shell subassemblies, a movable inner shell subassembly slidable within one of the two outer shell subassemblies, and a mounting fixture for securing the stationary subassemblies to a fixed object. One of the cable portions has one end secured to a movable object and the other end secured to the inner shell subassembly. The other cable portion has one end secured to a fixed object and the other end secured to the other of the outer shell assemblies. During normal conditions, the cable portions are securly connected together. Upon the application of a predetermined amount of force to the movable portion of the cable, the inner shell subassembly withdraws from the one outer shell subassembly in order for disconnection of the cable portions to take place in a reliable, safe and efficient manner.

9 Claims, 5 Drawing Figures

RELEASABLE CABLE CONNECTOR ASSEMBLY FOR USE BETWEEN A MOBILE AND STATIONARY OBJECT

STATEMENT OF GOVERNMENT INTEREST

The invention described herein may be manufactured and used by or for the Government for governmental purposes without the payment of any royalty thereon.

BACKGROUND OF THE INVENTION

This invention relates generally to connector assemblies, and, more particularly, to a cable connector assembly which provides signal flow integrity between a mobile object such as a projectile or test vehicle and a stationary object such as a data processing facility during lift-off of the projectile. Additionally, the connector assembly permits reliable cable separation to take place at a predetermined point in the projectile trajectory.

There are many occasions when it is highly desirable to provide signal flow integrity between a movable and a stationary object. Generally such occasions arise during the lift-off of a projectile or test vehicle when information must be effectively relayed to a data processing facility. There are currently various systems or methods available for retrieving the test data is to be relayed between the projectile (mobile object) and the data collection or processing facility (stationary object). It is essential in each of these systems or methods to reliably provide communication between the projectile or mobile test vehicle and the stationary data processing facility. These prior techniques and systems have advantages and disadvantages which are directly dictated by one or more of the following factors:

1. the travel distance between the start of the projectile or test vehicle movement and the completion of the test and data acquisition period;
2. the amount of serviceable hardware to be salvaged at the conclusion of the test;
3. the volume of the data to be communicated between the projectile and the stationary data processing facility;
4. the structural integrity of the system and the safety of adjacent personnel;
5. the various stress/load dynamics subjected to the system;
6. the critical event timing requirements; and
7. the project budgeting and scheduling parameters.

Such prior methods and systems for data retrieval can be classified into two basic concepts. The first concept being data acquisition which requires electronic storage devices to be mounted in the projectile or mobile vehicle and the second being data acquisition techniques which involve the direct cabling between the projectile or the mobile test vehicle and a stationary electronic storage device located at the stationary processing facility.

A typical device which exemplifies the first type of method or system of data acquisition relies upon the use of a radio transmitter to relay test data to a stationary receiver located at the data processing facility during the test. Another such technique uses a data storage device which relies on an ejection/parachute mechanism to retrieve the test data after the test has been concluded.

Disadvantages inherent in the above two systems are, for example, the loss of extensive and/or expensive electronic components in the first case as well as problems arising from RF interference. The ejection mechanism and parachute in the second case must both function flawlessly or all the test data may be lost. Both methods or systems are not only expensive and highly vulnerable to various types of failure, but each has a limited capacity in the volume of data they may handle. These systems are therefore used primarily in tests that span great distances and require fewer channels of communication.

The second type of data acquisition techniques or systems involve the use of direct cabling between the projectile and the stationary data processing facility. These type of data retrieval systems overcome much of the problems associated with the first type of techniques described above since the volume of data to be communicated is unrestricted by virtue of the design of the system, require much lower budget impact, and greatly reduces the likelihood of electrical interference. The only drawback of such systems is their limitation to a reasonable travel distance of the mobile projectile between the start of the test and the completion of the test and data acquisition.

In general, however, the second type of data acquisition techniques or systems are preferable for projectile or test vehicle data acquisition. The following analysis of such systems provides information which must be taken into consideration when designing the cable connector of such data acquisition systems. One such cable connector provides release of the cable at the point of the mobile projectile or component. The advantage of such a release includes high salvageability of hardware and low load factors on the projectile. The disadvantages, however, include a high possibility of damage to surrounding objects, high launch dynamic forces at the separation of the connector and a cable arresting system is required.

A more reasonable cable connecting technique would involve release of the cable at the stationary component. The advantages of such a system are that there is little chance of damage to surrounding objects, no launch forces at the connector up to the point of separation, no cable arresting system is required and the overall range and safety factor is substantially increased. The disadvantage would be that there is less salvageable hardware and a slight increase in stationary facility load factors.

Currently there are three methods of release at the stationary component. These are (1) to blow the components apart; (2) to spring or push the components apart; or (3) to pull them apart as the cable becomes taut. The disadvantages in blowing or springing the connector apart is the requirement for explosive devices, compressed gases or springs which are contingent upon an event timing system to accomplish cable separation at a predetermined time. There are several factors, therefore, which make these methods vulnerable to failure and create range safety hazzards.

The pull-apart method represents the cleanest and most advantageous method of cable separation since there are fewer movable and/or stationary objects to entangle the data umbilical cord, potential damage to range structures is substantially reduced, no event timing or pyrotechnic devices are required, the procurement cost and lead time is reduced through in-house fabrication and the overall range safety factor is substantially improved. In view of the above factors, it is clearly evident that a pull-apart separation system or connector assembly would produce an ideal method of cable separation after the acquisition of test data from a projectile at liftoff.

Heretofore, prior attempts at such pull-apart separation systems or connector assemblies left much to be desired in the integrity of the cable connections, the insurance of separation at a proper time, and the salvageability of the greatest amount of hardware. As a result, such pull-apart techniques have generally not been used with past data acquisition procedures.

SUMMARY OF THE INVENTION

The releasable cable connector assembly of this invention overcomes the problems encountered in the past and set forth in detail hereinabove. This cable connector assembly is designed as a high density connector to provide signal integrity between a mobile test vehicle such as a projectile and a stationary data processing facility during static and/or dynamic testing. In addition, the connector assembly of the present invention simply, reliably and cost effectively allows for the separation of the stationary and mobile portions of the data cable interconnecting the projectile or test vehicle with the data processing facility.

The releasable cable connector assembly of this invention is made up of four basic subassemblies; (1) a first large stationary outer shell subassembly, (2) a second large stationary outer shell subassembly, (3) a removably or releasably mounted inner shell subassembly, and (4) a mounting fixture for mounting the first and second subassemblies to a stationary supporting structure.

More specifically, the two large outer shell subassemblies each include a cylindrically or tubular-shaped member, with these members being joined together end to end. The tubular-shaped member of the first shell subassembly has fixedly secured at one end thereof a stationary connector mounting ring and female portion of a conventional cable connector and at the other end thereof a cable clamp for fixedly securing the stationary portion of the data cable in place.

The tubular-shaped member of the second outer shell subassembly houses therein the inner releasable shell subassembly. In addition, this tubular-shaped member has secured to one end thereof a releasable or break-away end cover which includes a cable clamp for securing the releasable portion of the data cable thereto. The other end of the tubular-shaped member is fixedly secured to the tubular-shaped member of the first shell subassembly.

The releasable inner shell subassembly includes a tubular-shaped member which contains therein an inner cable clamp for securing the releasable portion of the data cable in place. In addition, the end of the tubular-shaped member adjacent the first stationary outer shell subassembly has a cable connecter mounting ring and a male portion of the conventional cable connector for securing the releasable portion of the data cable in place. The other end of the tubular-shaped member of the inner shell subassembly is initially open, being closed by the releasable or break-away cover of the second outer shell subassembly.

There is approximately 1/16 inch clearance between the wall of the tubular-shaped member of the inner shell subassembly and the wall of the tubular-shaped member of the second outer shell subassembly. The function of the inner shell subassembly is to mate the stationary portion of the data cable with the mobile or releasable portion of the data cable as well as provide a supporting guide surface of specific mass to ensure alignment of cable connector pins during the cable pull-apart operation at a preselected time after lift-off.

During pre-launch, the releasable portion of the data cable is positioned and secured within the tubular-shaped element of the inner shell subassembly. The conductors of the releasable portion of the data cable are connected to the appropriate pins of the male portion of the cable connector of the inner shell subassembly. The releasable portion of the data cable is then connected to the stationary portion of the data cable by the interconnection between the male portion of the cable connector associated with the inner shell subassembly and the female portion of the cable connector of the first stationary outer shell subassembly, respectively.

During the initial stage (lift off) or launch of the projectile the entire data cable remains intact for appropriate data transmission. At a predetermined time after lift off or launch, such as when the cable is stretched out approximately 150 feet and subjected to approximately 700 pounds force, the releasable or mobile portion of the data cable, together with the inner shell subassembly and break-away cover of the second outer shell subassembly are pulled apart from the stationary portion of the data cable and first and second stationary outer shell subassemblies. This feature of the present invention enables the pull-apart disconnection of the data cable to take place rapidly, reliably, and with a minimal amount of injury to the stationary outer shell subassemblies of the connector assembly. In this manner, the stationary outer shell subassemblies of this invention remain intact for subsequent reuse.

It is therefore an object of this invention to provide a releasable cable connector assembly which releasably secures a data cable in place in order to provide signal integrity between a mobile object and a stationary object.

It is another object of this invention to provide a releasable cable connector assembly which is made of a minimal number of parts, and is highly reliable in operation so as to provide efficient cable disconnect capability.

It is still another object of this invention to provide a releasable cable connector assembly which minimizes damage to surrounding stationary structures and data processing equipment.

It is still a further object of this invention to provide a releasable cable connector assembly which can provide highly reliable signal paths for 900 to 1100 data input points.

It is still a further object of this invention to provide a releasable cable connector assembly which affords great safety to surrounding personnel.

It is an even further object of this invention to provide a releasable cable connector assembly in which a majority of the components are reusable.

It is still another object of this invention to provide a releasable cable connector assembly which is economical to produce and which utilizes conventional, currently available components that lead themselves to standard mass producing manufacturing techniques.

For a better understanding of the present invention, together with other and further objects thereof, reference is made to the following description taken in conjunction with the accompanying drawing and its scope will be pointed out in the appended claims.

DETAILED DESCRIPTION OF THE DRAWING

DETAILED DESCRIPTION OF THE PREFERRED EMBODIMENT

Figure 1:
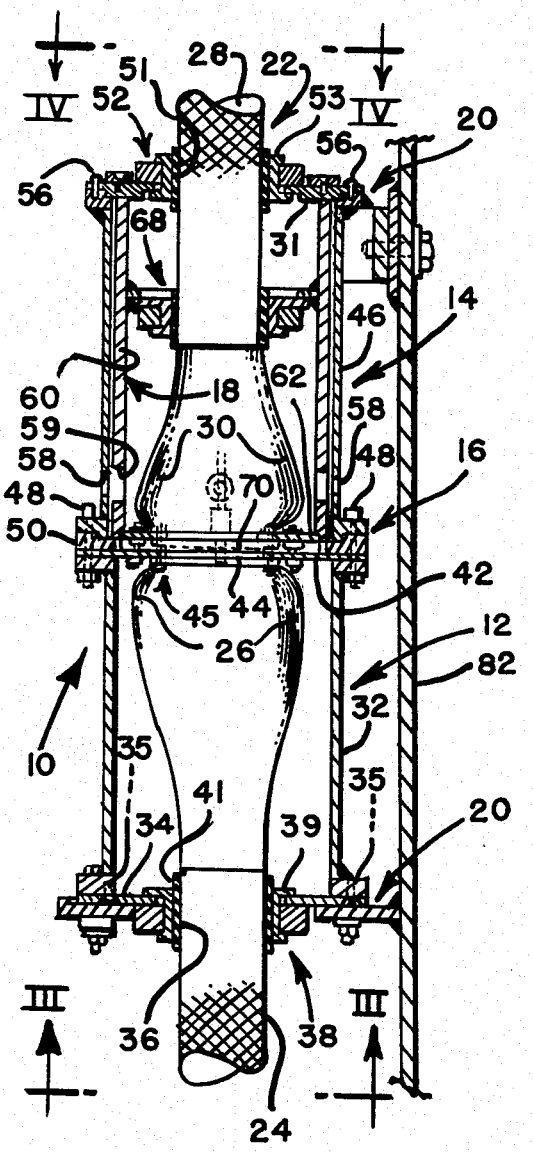
FIG. 1 is a side elevational view of the releasable cable connector assembly of this invention shown partly in cross-section.

Reference is now made to FIG. 1 of the drawing which shows partially in cross section the releasable cable connector assembly 10 of this invention. The connector assembly 10 of the present invention is made up of four major components which will be set forth in detail hereinbelow. The first two major components are in the form of a first stationary outer shell subassembly 12 and a second stationary outer shell subassembly 14. Outer shell subassemblies 12 and 14 are connected together in an end to end fashion in a manner described in detail hereinbelow to form a stationary outer housing 16 of the releasable cable connector assembly 10 of this invention.

The third major component of the present invention is in the form of a releasable inner shell subassembly 18 which is slidably mounted within the second stationary outer shell subassembly 14 in a manner described in more detail hereinbelow. The fourth major component is in the form of a stationary mounting fixture 20. Mounting fixture 20 secures the stationary outer housing 16 to any fixed member such as part of a data processing facility.

The releasable cable connector assembly 10 of the present invention is utilized to releasably secure a data cable 22 between a stationary object such as a data processing facility (not shown) and a mobile object such as a projectile or test vehicle (not shown). Although the following description refers to a projectile at lift off or launch, the present invention is capable of use with any type of mobile and stationary objects which require releasable cabling therebetween.

Still referring to FIG. 1 of the drawing the data receiving cable 22 is utilized to receive incoming data from a projectile at lift off and for transmitting this data to a stationary data processing facility on the ground or other fixed location. Cable 22 is made up of two portions, a stationary cable portion 24 having numerous conductors 26 extending therefrom and a releasable or mobile cable portion 28 having conductors 30 protruding therefrom. During data transmission, it is necessary to provide extremely reliable interconnection between the conductors 26 and 30 of cable portions 24 and 28. After a predetermined time after lift off, reliable separation of the cable portions 24 and 28 must take place. It is the releasable cable connector assembly 10 of this invention which provides such reliable interconnection and release of cable 22.

More specifically, stationary portion 24 of cable 22 is fixedly secured within the first stationary outer shell subassembly 12 while the mobile, or releasable portion 28 of cable 22 is fixedly secured to the removeable inner shell subassembly 18 in addition to being fixedly secured to a releasable or break-away cover 31 of the second stationary outer shell subassembly 14.

Reference is now made to FIGS. 1 through 5 of the drawing for the detailed description of the various components which make up the releasable cable connector assembly 10 of the present invention. For ease of understanding of the present invention, each specific component will be set forth in detail with the interconnection of the various components being set forth thereafter.

Figure 3:
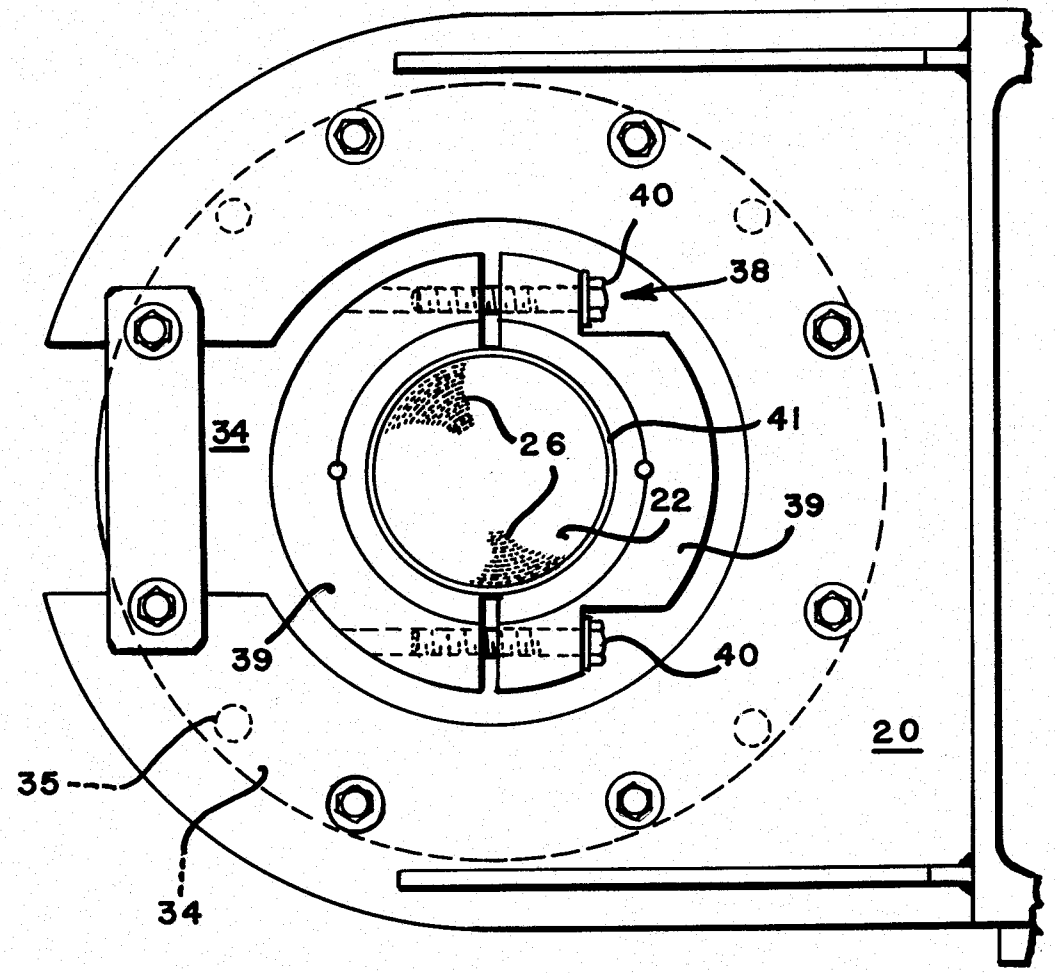
FIG. 3 is an enlarged end view taken along line III—III of FIG. 1 of the releasable cable connector assembly of this invention.
Figure 4:
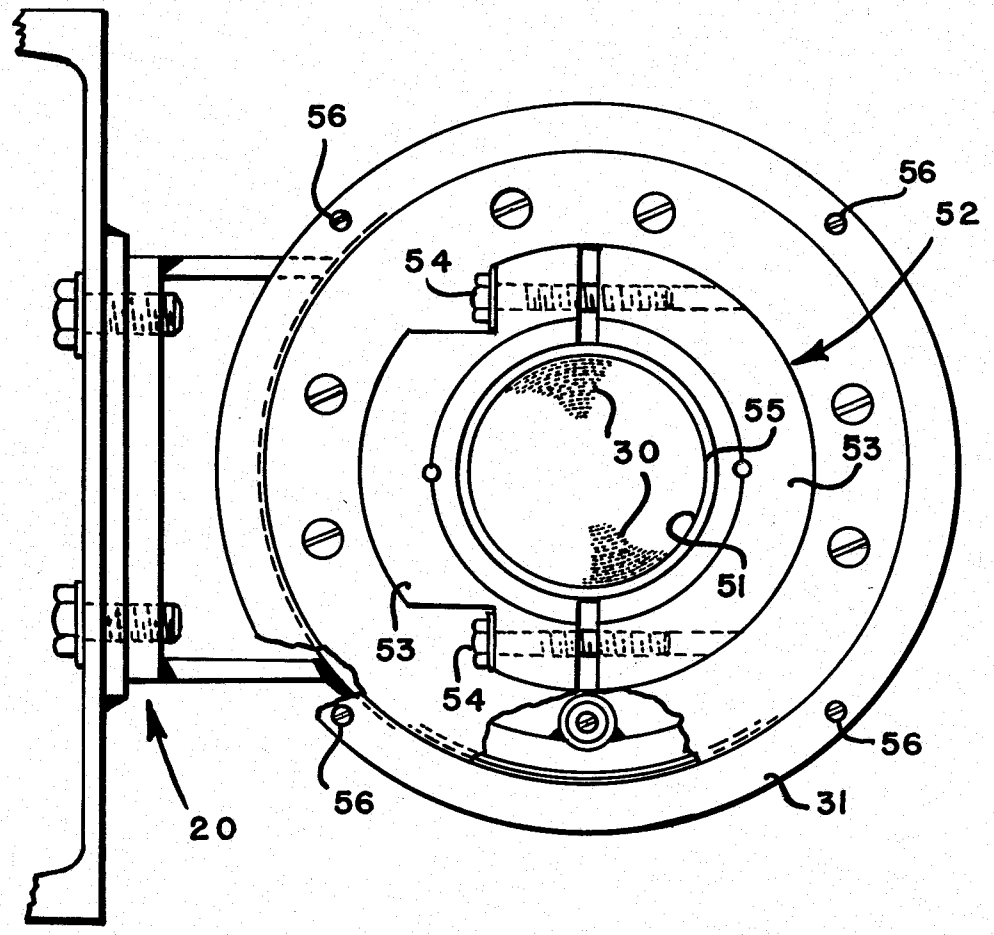
FIG. 4 is an enlarged end view taken along line IV—IV of FIG. 1 of the releasable cable connector assembly of this invention.

As shown in FIG. 1 of the drawing, the first stationary outer shell subassembly 12 is made up of an elongated, preferably cylindrical, tubular-shaped member 32. Secured to one end of tubular-shaped member 32 is a cover 34. As shown in FIGS. 1 and 3 cover 34 is secured to tubular-shaped member 32 by any suitable securing means such as bolts 35. In addition, mounting fixture 20 is secured to member 32 in a manner described in greater detail hereinbelow.

Centrally located within cover 34 is an opening 36 through which the stationary portion 24 of cable 22 may be inserted. Fixedly securing cable portion 24 to cover 34 is a cable clamp 38 of any suitable design. As shown in FIG. 3, cable clamp 38 is made of a pair of cable holders 39 secured together by bolts 40. Any suitable gasket 41 is fitted between cable portion 24 and holders 39.

Figure 2:
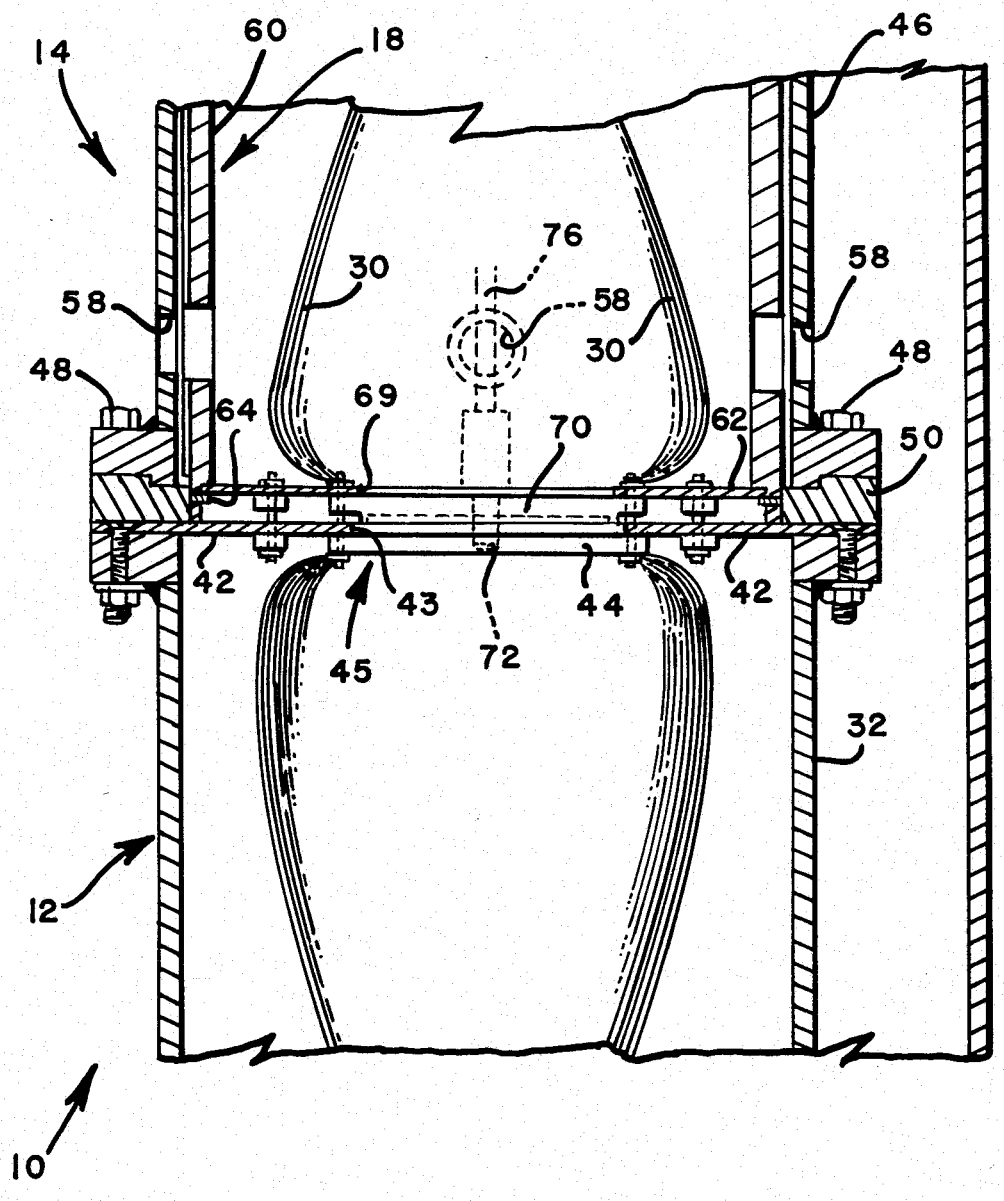
FIG. 2 is an enlarged side elevational view, shown partly in cross-section, of the connector mounting rings and mating connector portions of the releasable cable connector assembly of this invention.

The opposite end of the stationary tubular-shaped member 32 has fixedly secured thereto a stationary connector mounting ring 42 (shown in FIGS. 1 and 2). Mounting ring 42 has a centrally located opening 43 therein. Located adjacent opening 43 and fixedly secured to mounting ring 42, is the female portion 44 of a conventional connector 45 commercially available for example, from Hughes Corporation. Female portion 44 of cable connector 45 has a plurality of conductive indentations having conductors 26 of the stationary portion 24 of cable 22 connected thereto in a conventional manner. In this manner approximately 900–1100 conductors 26 of the stationary cable portion 24 are available for subsequent interconnection to the conductors 30 of releasable cable portion 28 in a manner described below.

As clearly shown in FIGS. 1 and 2 of the drawing, the second stationary outer shell subassembly 14 is formed of an elongated, preferably cylindrical, tubular-shaped member 46. Member 46 is fixedly secured at one end thereof to the tubular-shaped member 32 by means of any conventional securing means, such as bolts 48. Interposed between tubular-shaped member 46 and tubular-shaped member 32 is an annular-shaped spacer 50. Spacer 50 is utilized to maintain inner shell subassembly 18 a preselected distance from female connector portion 44 in a manner to be set forth in detail hereinbelow.

Still referring to the makeup of stationary outer shell subassembly 14, the other end thereof contains a break-away or releasable cover 31. Cover 31, as clearly shown in FIG. 4 of the drawing has a centrally located opening 51 for receiving the releasable portion 28 of cable 22 therethrough. Any suitable cable clamp 52 such as described in conjunction with the first outer shell subassembly 12 fixedly secures releasable cable portion 28 to cover 31. Clamp 52 also includes holders 53, bolts 54 and gasket 55.

In addition, cover 31 is releasably secured to outer tubular-shaped member 46 by means of a plurality of brass screws 56 which are capable of shearing under a predetermined amount of force. It should be realized that although brass screws 56 are shown as being used with the present invention, they may be substituted for by any type of securing means which are capable of being rendered ineffective as a securing means under a predetermined amount of force.

Also formed within stationary tubular-shaped member 46 are a plurality of viewing and vacuum relief ports 58. Ports 58 serve the purpose of permitting inspection to take place of the joined together cable portions 24 and 28 as well as allowing the relief of any vacuum which may be built up within the housing 16 during the release of inner subassembly 18. Any vacuum created during the rapid withdrawal of inner subassembly 18 from outer subassembly 14 could adversely affect the disconnect procedure between cable portions 24 and 28 if not eliminated.

Still referring to FIGS. 1 and 2 of the drawing, reference is now made to the inner shell subassembly 18. Inner shell subassembly 18 is made up of an elongated, preferably cylindrical, tubular-shaped member 60 which has a diameter slightly less than the diameter of outer stationary member 46. This enables a clearance of, for example, approximately 1/16 of an inch therebetween. In this manner, inner tubular-shaped member 60 may be inserted and be slidable within outer tubular-shaped member 46. Also situated within tubular-shaped member 60 are a plurality of openings 59 which operate in conjunction with ports 58 in the manner described above.

As clearly shown in FIG. 2, at one end of tubular-shaped element 60 is secured a cable connector mounting ring 62. Mounting ring 62 is held in place by a plurality of retaining pins 64 as well as a mounting assembly 66 shown in greater detail in FIG. 5 of the drawing. A detailed description of mounting assembly 66 will be set forth in detail hereinbelow.

Still referring to the makeup of inner shell subassembly 18, an inner cable clamp 68 fixedly secures the releasable portion 28 of cable 22 to subassembly 18. Inner cable clamp 68 is situated substantially midway between the ends of member 60 and within the interior thereof. Clamp 68 includes the same elements as clamps 38 and 52 and therefore is not described in detail. Clamp 68 fixedly secures releasable cable portion 28 to tubular-shaped member 60 so that upon the withdrawal or release of the releasable cable portion 28 the entire releasable or mobile inner shell subassembly 18 can be removed therewith.

Still referring to FIGS. 1 and 2 of the drawing, connector mounting ring 62 is shown having a centrally located opening 69 therein. A male portion 70 of conventional, commercially available mating cable connector 45 is fixedly secured to mounting ring 62 over opening 69. The conductors 30 of the releasable portion 28 of cable 22 are fixedly secured to conductive pins (not shown) of male connector portion 70. The conductive pins of male portion 70 of connector 45 are capable of mating within the conductive indentations (not shown) of female portion 44 of connector 45. The proper alignment and spacing between inner shell subassembly 18 and the first outer stationary shell subassembly 12 is accomplished by guide ring 50 which is interposed between members 46 and 32 as well as a plurality of guide pins 72 found as part of mounting assembly 66 shown more clearly in FIG. 5 of the drawing.

Figure 5:
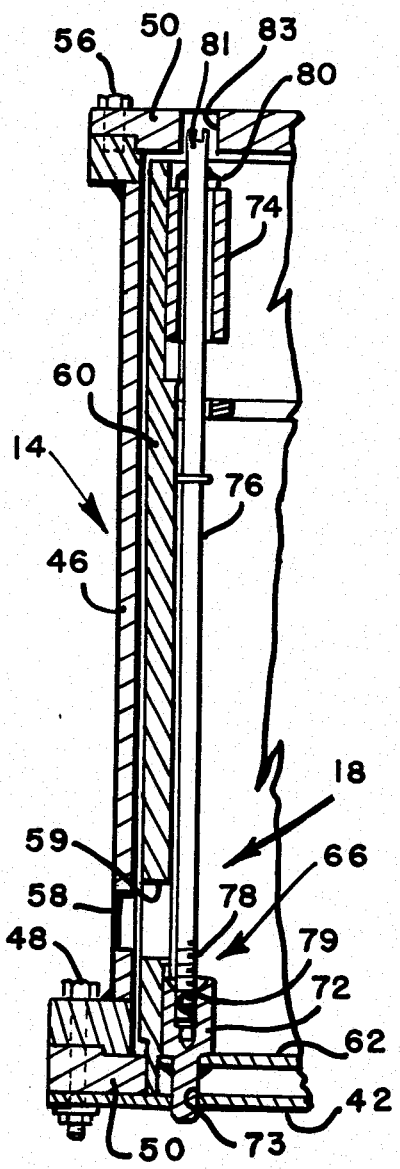
FIG. 5 is an enlarged, detailed view of one of the guide pins utilized with the releasable cable connector assembly of this invention and shown partly in cross-section.

Reference is now made to the plurality of mounting assemblies 66, only one of which is in FIG. 5. Each mounting assembly 66 includes guide pins 72 which are fixedly secured, preferably by welding, to connector mounting ring 62 of inner shell subassembly 18. Pins 72 are of sufficient length to protrude through mounting ring 62 and be inserted within openings 73 located within the stationary connector mounting ring 42. This arrangement prevents any misalignment from occurring between inner shell subassembly 18 and stationary outer shell subassembly 12.

In addition, each mounting assembly 66 has a plurality of elongated guide elements 74 fixedly attached to member 60 of inner shell subassembly 18. A guide rod 76 passes through each guide element 74. Each guide rod 76 has a threaded bottom end 78 which threadably mates within an internally threaded portion 79 of each of the plurality guide pins 72. The other or upper end 81 of guide rod 76 has a washer-type element 80 fixedly secured thereto. Therefore, as each guide rod 76 is threaded into a respective guide pin 72, cable connector mounting ring 62 is drawn tightly against the tubular-shaped member 46. This tightening can be accomplished through an opening 83 formed within the releasable cover 31 by the use of any type of screw driver-like device which can be inserted within the bifurcated upper end 81 of guide rod 76.

The entire stationary housing 16 is rigidly positioned by the pair of mounting fixtures 20. Mounting fixtures 20 secure the first outer shell subassembly 12 and the second outer shell subassembly 14 to a stationary structure 82 which may be formed as part of a stationary data processing facility. Furthermore, if additional support may be required, another mounting fixture may encompass the central portion of housing 16 thereby providing additional structural support to the releasable cable connector assembly 10 of this invention.

OPERATION OF THE PREFERRED EMBODIMENT OF THIS INVENTION

As clearly depicted in FIG. 1 of the drawing, in its stationary position, the stationary and releasable portions 24 and 28 of data cable 22 are joined together by means of cable connector assembly 10 of the present invention. More specifically, the connection takes place by the interconnection and mating relationship between male and female portions 44 and 70 of commercially available cable connector 45. With appropriate tightening of clamps 38, 68 and 52, cable 22 is formed into a reliable, high integrity, transmitting path for data from a mobile object such as a projectile to a stationary object such as a data processing facility.

During liftoff of the projectile, data is continually being transmitted through cable 22 between the projectile and the data processing facility. This data transmission takes place generally within less than 0.1 seconds during projectile lift off before separation of cable 22 takes place. In general, there are between 900 and 1000 contact points between male and female connector portions 44 and 70. It is essential that these contact points remain connected to each other during the data transmission period.

As lift off takes place, under approximately 125 pounds pressure, each of the brass screws 56 securing cover 31 to the second outer stationary shell subassembly 14 fractures. The total applied force (depending upon the number of screws 56) is approximately 700 pounds of force. Upon fracture of screws 56, continual rapid movement of releasable portion 28 of cable 22 removes cover 31 along with inner shell subassembly 18. The withdrawal of inner shell subassembly 16 from the second outer stationary shell subassembly 14 takes place at a rate of approximately 180 feet per second. As a result of the stability and the added guiding ability of the present invention, minimal damage will occur at connector 45 and to surrounding personnel as the releasable portion 28 of cable 22 is rapidly withdrawn from stationary housing 16.

With the use of the present invention, the next projectile need merely have its cable portion 28 connected to a new inner shell subassembly 18. This new inner shell subassembly 18 can once again be inserted within the second stationary outer shell subassembly 14 for subsequent interconnection between portions 24 and 28 of cable 22. This allows for rapid reuse of the connector assembly 10 of this invention for further projectile data transmission.

The stationary components of the present invention, that is, outer shell subassemblies 12 and 14, remain completely intact during projectile lift off and are therefore completely reusable. Only the inner shell subassembly 18 need be replaced with the present invention. In addition, all components of the present invention can be manufactured independently of each other and are completely interchangeable. Consequently, the efficiency and economic gains attained by the use of this invention are immense. It is therefore clearly evident that data acquisition can be rapidly and effectively obtained at a minimal expense by the use of the releasable cable connector assembly 10 of this invention.

Although this invention has been described with reference to a particular embodiment, it will be understood that this invention is also capable of further and other embodiments within the spirit and scope of the appended claims.

I claim:

1. A cable connector assembly for releasably securing together a pair of cable portions of a cable, comprising:

stationary means for fixedly securing therein one of said cable portions during release of said pair of cable portions from one another;

means releasably slidable within said stationary securing means for fixedly securing thereto the other of said cable portions;

means releasably connected to said stationary securing means for fixedly securing said other of said cable portions directly thereto, said means releasably connected to said stationary securing means including a cover-like element and at least one shearable element for releasably connecting said cover-like element to said stationary securing means, said cover-like element capable of being released from said stationary securing means when said shearable element is subjected to a preselected amount of force sufficient to cause said element to shear; and means included as part of said stationary securing means and said releasably slidable means for releasably connecting said one cable portion to said other cable portion;

whereby, upon the application of said preselected amount of force to said shearable element through said cover-like element and said other cable portion, substantially simultaneously said cover-like element is released from said stationary means, said releasably slidable means is withdrawn from said stationary means and said pair of cable portions disconnect from one another.

2. A cable connector assembly as defined in claim 1 wherein said stationary securing means comprises a first outer shell subassembly and a second outer shell subassembly, one end of said first outer shell subassembly being connected to one end of said second outer shell subassembly.

3. A cable connector assembly as defined in claim 2 wherein said releasably slidable means comprises an inner shell subassembly, said inner shell subassembly being slidably mounted within said second outer shell subassembly.

4. A cable connector assembly as defined in claim 3 wherein said second outer shell subassembly comprises a tubular-shaped member, said tubular shaped member having one end thereof connected to said one end of said first outer shell subassembly, said cover-like element being releasably connected to the other end of said tubular-shaped member, and said other cable portion being secured to said releasable cover-like element.

5. A cable connector assembly as defined in claim 4 wherein said first outer shell subassembly comprises a tubular-shaped member having one end thereof connected to said one end of said tubular-shaped member of said second outer shell subassembly, and said means for releasably connecting said one cable portion to said other cable portion being made of two parts, one of said parts being connected to said one end of said tubular-shaped member of said first outer shell subassembly.

6. A cable connector assembly as defined in claim 5 wherein said inner shell subassembly comprises a tubular-shaped member, and the other part of said means for releasably connecting said one cable portion to said other cable portion being connected to one end of said tubular-shaped member of said inner shell subassembly.

7. A cable connector assembly as defined in claim 6 wherein said inner shell subassembly comprises means for aligning said two parts of said releasable cable connecting means together as well as securing said other part of said releasable cable connecting means to said tubular-shaped member of said inner shell subassembly.

8. A cable connector assembly as defined in claim 7 wherein said tubular-shaped members of both said second outer shell subassembly and said inner shell subassembly have means therein for viewing said releasable cable connecting means as well as relieving any vacuum build up within said second outer shell subassembly during disconnection of said cable portions.

9. A cable connector assembly as defined in claim 8 further comprising means for securing said first and said second outer shell subassembly to a fixed object.

* * * * *